US006050865A

United States Patent [19]

Bohmann et al.

[11] Patent Number: 6,050,865

[45] Date of Patent: Apr. 18, 2000

[54] SHIP DRIVE WITH A DRIVE ENGINE AND DIRECTLY DRIVE PROPELLER SHAFT

[75] Inventors: Heinz-Jürgen Bohmann; Wilhelm Schäfer, both of Witten, Germany

[73] Assignee: A. Friedr. Flender AG, Bocholt, Germany

[21] Appl. No.: 09/108,354

[22] Filed: Jul. 1, 1998

[30] Foreign Application Priority Data

Jul. 3, 1997 [DE] Germany ..... 197 29 046

[51] Int. Cl.[7] ..... B63H 20/14

[52] U.S. Cl. ..... 440/75

[58] Field of Search ..... 114/75, 74; 74/720, 74/665 R, 730.1, DIG. 8

[56] References Cited

U.S. PATENT DOCUMENTS 4,305,710 12/1981 Schneider ..... 440/75

4,368,048 1/1983 Wedler ..... 440/75

5,181,176 1/1993 Gebhardt et al. ..... 440/75

*Primary Examiner*—Stephen Avila

*Attorney, Agent, or Firm*—Max Fogiel

[57] ABSTRACT

A ship drive with a drive engine and a propeller shaft which is directly connected therewith and provided with a propeller and the thrust of which is taken up by a thrust bearing, as well as an auxiliary drive consisting of an electric engine which is to operate selectably as a generator or a motor and which is connected with a transmission by way of a clutch in that a rotationally stiff, but axially pliant diaphragm coupling connected with the propeller shaft and the auxiliary bearing forms the play-free mechanically positive connection and in normal operation the auxiliary thrust bearing is clamped by means of pressure blocks against the flanges of the drive side and the thrust shaft.

8 Claims, 2 Drawing Sheets

SHIP DRIVE WITH A DRIVE ENGINE AND DIRECTLY DRIVE PROPELLER SHAFT

BACKGROUND OF THE INVENTION

The invention relates to a ship drive with a drive engine and directly driven propeller shaft.

SUMMARY OF THE INVENTION

A ship drive according to the category is known from DE 196 23 914 A1. This ship drive consists of a drive engine and propeller shaft which is directly connected therewith and provided with a propeller and the thrust of which is taken up by a thrust bearing. For auxiliary and emergency operation the known ship drive has a supplementary drive consisting of an electric engine which is to be operated selectably as a generator or a motor and which is connected with a transmission by way of a clutch. A gearwheel of the transmission surrounds the propeller shaft, which is connected with the gearwheel by way of a flexible coupling. Arranged between transmission and drive engine and on a separate section of the propeller intermediate shaft is a play-free switchable coupling, which is combined with a play-free auxiliary thrust bearing transmitting the propeller thrust. In the case of auxiliary or emergency operation of the ship, this auxiliary thrust bearing is activated, wherein the correspondingly reduced propeller thrust is introduced by way of the auxiliary thrust bearing to a thrust bearing arranged in the drive engine and thus into the ship hull.

Disadvantageous in this known ship drive is the arrangement of a constructionally costly switchable coupling in the form of a known hydraulically-acting cone bolt clutch, which demands much space and makes the ship drive greatly more expensive.

It is the task of the invention to constructionally simplify the known ship drive and thus make it so favourable in cost that it is of economic interest for an installation without statutory obligation.

One of the significant constructional simplifications in the case of the ship drive according to the invention consists in replacing the expensive switchable clutch by a rotationally stiff, but axially pliant diaphragm coupling. The diaphragm coupling is clamped in by one element between a flange of the propeller intermediate shaft and an opposite flange of the thrust shaft. The other element of the diaphragm coupling is fastened to the support collar of the auxiliary thrust bearing. The two elements of the diaphragm coupling are held together by way of cone screw bolts which are arranged to be distributed at the circumference and which are supported in a ring. In normal operation the pressure blocks of the auxiliary thrust bearing are tightened against the flanges of the drive side and the propeller intermediate shaft, so that the full propeller thrust is transmitted by way of this bearing statically into the thrust bearing of the drive engine and can thus be introduced into the ship hull. The diaphragm coupling takes over the torque transmission. The tightening of the pressure blocks is effected by a threaded ring, which at the rear side of the flange of the thrust shaft is arranged thereon and supported against the inwardly disposed surface of a support collar formed in bell shape. The support collar is in turn fixedly connected with the flange at the drive side and journalled on the thrust shaft. In order to be able to actuate the threaded ring, cutouts, which extend through the wall are provided in the circumferential region of the support collar.

In the case of auxiliary and emergency operation of the ship the screw bolts are withdrawn from the diaphragm coupling, so that a direct connection between propeller intermediate shaft and thrust shaft and thus the drive side no longer exists. According to whether in the case of emergency operation a forward travel or a reverse travel is concerned, the corresponding pressure block of the auxiliary thrust bearing comes into contact. This contact enables the transmission of the reduced propeller thrust to the thrust bearing arranged in the drive engine. According to the respective level of power to be transmitted in the emergency operation, a pressure oil lubrication is required, or a filling up of the bearing is sufficient. In the former case the appropriate components have channels so that the supplied oil can pass into the region of the pressure blocks and conduct away friction heat from there. In the case of lower power the heat radiation reaches over the casing. So that the threaded ring cannot unintentionally rotate in the switched-in setting or the switched-out setting, it is secured by appropriate means, for example pins, wire snaps. Switched-out setting signifies in that case a previous rotation of the threaded ring so that the clamping is cancelled and the pressure blocks have the required play.

The proposed solution has the advantage that, as with known ship drives, torque transmission and thrust transmission are clearly separated. Due to the large torque and thrust fluctuations with usual drive by two-cycle motors, the absolute freedom of play of the individual components is a paramount requirement. To be mentioned as a further advantage of the ship drive according to the invention is that the play-free connection does not require a separate bed. This in turn has the consequence that the two thrust bearings, i.e. that in the drive engine and that in the auxiliary thrust bearing, cannot influence one another. In departure from the known solution the proposed solution is considerably simplified, which is also significant in terms of cost.

BRIEF DESCRIPTION OF THE DRAWINGS

The ship drive constructed in accordance with the invention is more closely explained in the drawing by reference to an example of embodiment. There.

DESCRIPTION OF THE PREFERRED EMBODIMENTS

Figure 1:
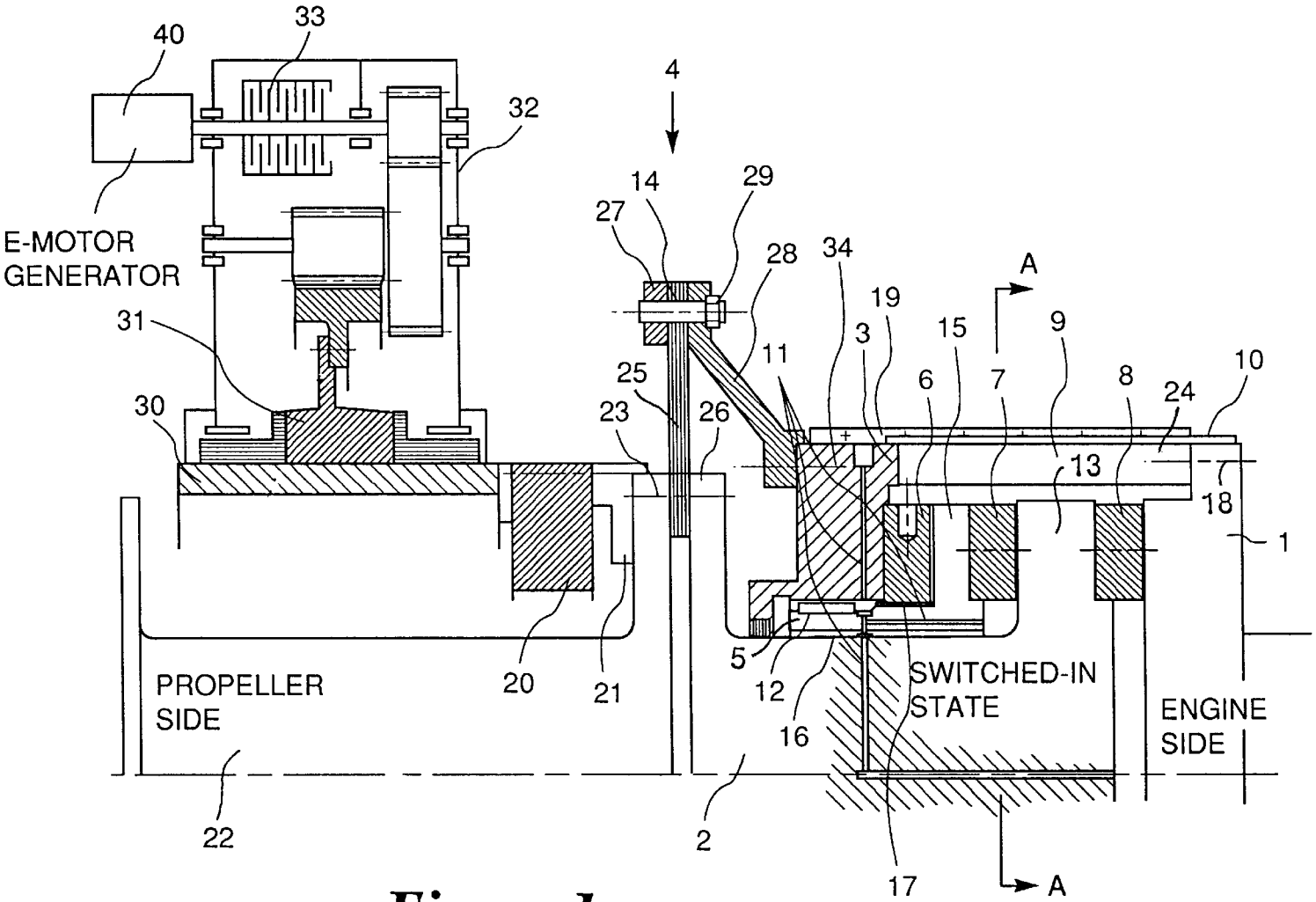
FIG. 1 shows a half-side longitudinal section through a ship drive, in the switched-in state, constructed in accordance with the invention

The drive engine, which is not illustrated in FIG. 1, usually a slow-running Diesel engine, is connected by way of a flange 1 at the dove side and by a diaphragm coupling 4, which is arranged in accordance with the invention, with a propeller intermediate shaft 22. The connection of the propeller intermediate shaft 22 with the actual propeller shaft inclusive of the propeller attached thereto is not illustrated here. It is only essential that here there is concerned a so called direct drive, in which the setting of the desired propeller rotational speed is effected by way of a regulation of the rotational speed of the drive engine. The arrangement of a transmission between drive engine and propeller is not necessary here. So that the ship still remains maneuverable even in the case of breakdown of the drive engine, a supplementary drive is provided. This consists of an electric engine 40, which is to be operated selectably as a motor or a generator and which is connected with a transmission 32 by way of a clutch 33. In this example of embodiment the transmission 32 is constructed as a twostage input transmission and the main gearwheel 31 is fastened to a hollow shaft 30, which engages around the propeller intermediate shaft 22. The connection of the transmission 32 with the propeller intermediate shaft 22 is effected by way of a highly elastic coupling 20, which is connected with the propeller intermediate shaft 22 by means of an annular divided flange 21. For that purpose, the propeller intermediate shaft 22 similarly has a flange 23.

Figure 2:
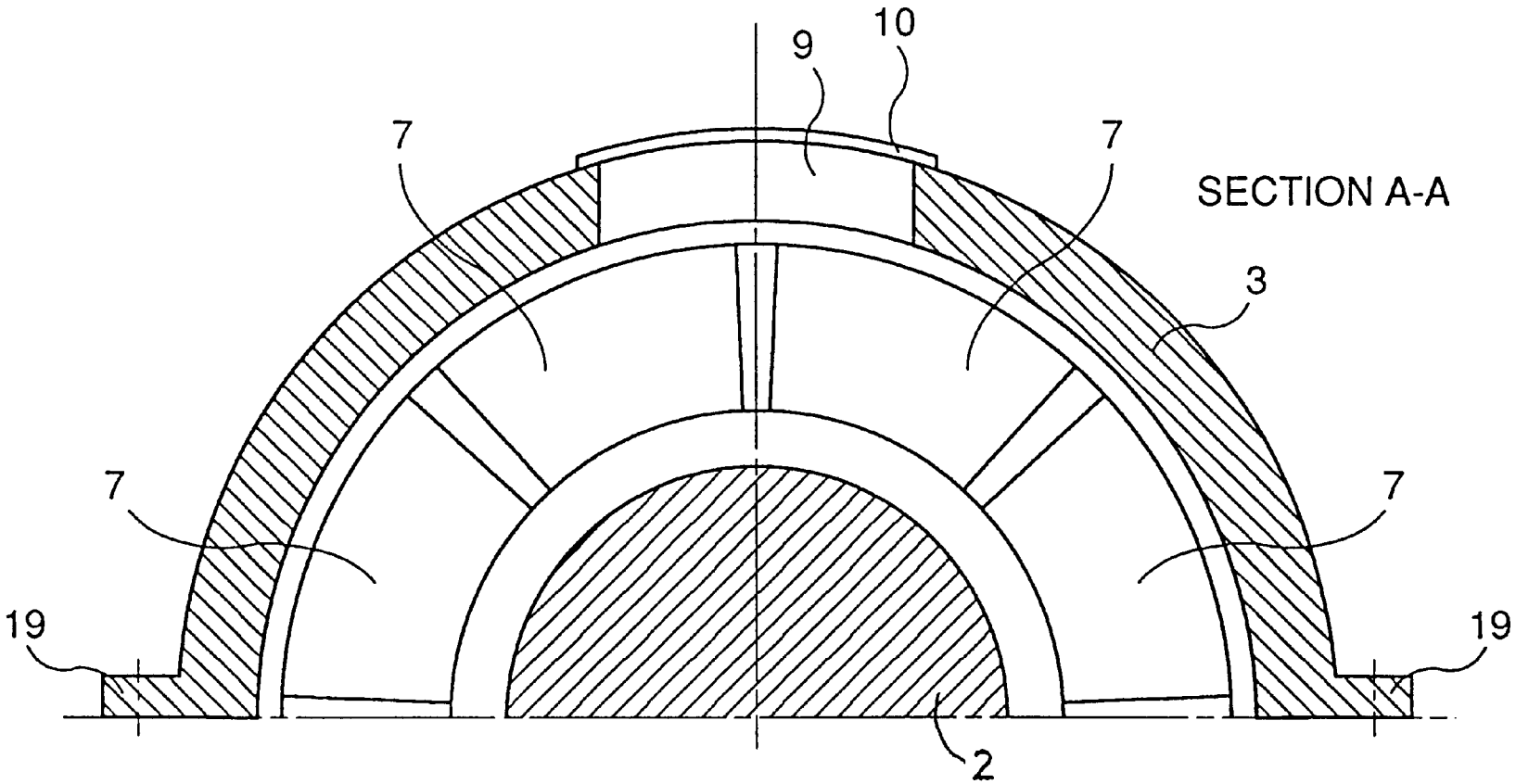
FIG. 2 shows a half-side section in the direction A—A in FIG. 1.

The transmission of the propeller thrust to a thrust bearing (not illustrated here) arranged in the drive engine is effected by way of forward pressure blocks 8 and reverse pressure blocks 7. The first-mentioned are fastened to an end face, which is opposite the flange 1 at the drive side, of the flange 13 of a thrust shaft 2. The reverse pressure blocks 7 are fastened to an end face, which faces the flange 13 of the thrust shaft 2, of a flange 15 of a receiving collar 5. The receiving collar 5 is arranged to be axially displaceable on a slide bearing 16 fastened on the thrust shaft 2. The receiving collar 5 is provided on the cylindrical part with a threaded section 17. A threaded ring 6 is rotatably arranged on this. The threaded ring 6 is supported by an end face, which faces the drive side, against the inner surface of a support collar 3 formed in bell shape. The support collar 3 is fixedly connected with the flange 1 at the drive side by screws 18. The axial displacement of the receiving collar 5 is effected by way of an adjusting spring 12, which is laid into a recess of the cylindrical part of the receiving collar 5 and engages in an axially extending groove of the support collar 3. The support collar 3 is journalled on the thrust shaft 2 by way of the cylindrical part of the receiving collar 5 and by way of the slide bearing 16. As FIG. 2 shows, the support collar 3 consists of two ring halves, which are connected together by way of a parting joint screw connection 19. The lubrication of the pressure blocks 7, 8 is effected by way of channels 11 which are arranged in the support collar 3, the receiving collar 5 and the thrust shaft 2 and which open into intermediate spaces in which the pressure blocks 7, 8 are arranged.

In normal operation the pressure blocks 7, 8 are clamped against the flanges 1, 13 by rotation of the threaded ring 6, so that the propeller thrust is introduced by way of this connection into the already-mentioned thrust bearing arranged in the drive engine. The diaphragm coupling 4, which is rotationally stiff, but axially yielding, takes over the torque transmission. In this example of embodiment the diaphragm coupling 4 consists of a highly elastic disc 25, which is clamped between the flange 23 of the propeller intermediate shaft 22 on the one hand and the flange 26 of the thrust shaft 2 on the other hand. The disc 25 is covered on the side remote from the main drive by a support ring 27 and on the other side by a flange 28 constructed in cover shape. The connection between support ring 27, disc 25 and flange 28 is effected by way of cone screw bolts 14, which are secured by nuts 29. The required connection of the diaphragm coupling 4 with the auxiliary thrust bearing takes place by way of screws 34, which connect the flange 28 of the diaphragm coupling 4 with the support body 8.

For the emergency operation, the supplementary drive described in the introduction is activated and the electric motor 40 drives the transmission 32 by way of the switched-in clutch 33, and the propeller intermediate shaft 22 by way of the resilient coupling 20. As this supplementary drive has a substantially lower power than the drive engine, the propeller thrust is also correspondingly reduced. Nevertheless, however, this must be absorbed. This happens in the manner that by means of an opening 9, which is let into the circumferential region of the support collar 3, the clamping action is released, in that the threaded ring 6 is rotated oppositely. The protective cover 10 over the opening 9 has to be removed beforehand. Moreover, after loosening of the nuts 29, the cone screw bolts 14 of the diaphragm coupling have to be drawn, so that no torque can be transmitted between propeller intermediate shaft 22 and the support collar 3. After elimination of the clamping actions, the pressure blocks 7, 8 have play. In the case of a forward travel in emergency operation the forward pressure blocks 8 come into contact with the stationary flange 1 at the drive side and statically transmit the reduced propeller thrust. The thus arising friction heat must be conducted way. According to the respective power to be transmitted, a filling up of the auxiliary thrust bearing is sufficient or a pressure lubrication is required by way of the already-mentioned channels 11. In the case of a reverse travel in emergency operation, the flange 13 of the thrust shaft 2 comes into contact with the reverse pressure blocks 7 and the reduced propeller thrust is conducted by way of the stationary receiving collar 5, threaded ring 6, support collar 3 and the flange 1 connected therewith on the drive side into the thrust bearing arranged in the drive engine.

What is claimed is:

1. A ship drive comprising: a drive engine and a propeller shaft connected directly to said drive engine; a propeller mounted on said shaft; a thrust bearing for taking up the thrust of said propeller; an auxiliary drive having an electric engine operable selectably as a generator or a motor; a transmission connected to said electric engine through a clutch; a gearwheel in said transmission; a propeller intermediate shaft surrounded by said gearwheel and connected to said gearwheel through a flexible coupling for producing a play-free, releasable and mechanically positive connection between said transmission and said drive engine; said drive engine having a drive side with a flange on a thrust shaft; an auxiliary thrust bearing holding said thrust shaft; said thrust bearing having forward and reverse pressure blocks and being activatable in case of auxiliary or emergency operation of the ship; reduced propeller thrust being transmitted to said thrust bearing through said auxiliary thrust bearing, said thrust bearing being arranged in said drive engine in the ship's hull; a rotationally stiff and axially pliant diaphragm coupling connected to said propeller shaft; said auxiliary thrust bearing forming a play-free and a mechanically positive connection, said auxiliary thrust bearing being clamped in normal operation by said pressure blocks against the flanges of said drive side and said thrust shaft.

2. A ship drive as defined in claim 1, wherein said propeller intermediate shaft and said thrust shaft each have a respective one of mutually facing flanges; a first element of said diaphragm coupling being clamped between said facing flanges, and second element of said diaphragm coupling being connected by screws to said auxiliary thrust bearing.

3. A ship drive as defined in claim 2, wherein said first element and said second element are connected by cone screw bolts distributed along a circumference; a support ring for supporting said screw bolts and bearing against said first element.

4. A ship drive as defined in claim 1, wherein said forward pressure blocks are fastened to an end face facing said flange at said drive side of the flange of said thrust shaft, said reverse pressure blocks being fastened to an end face facing the flange of said thrust shaft; a receiving collar with a flange arranged axially displaceable on said thrust shaft by a slide bearing on said thrust shaft; said receiving collar having a cylindrical part with an externally disposed threaded section;

a threaded ring on said threaded section and supported by an end face remote from said drive side against a support collar, said support collar being bell-shaped and connected with said flange at said drive side and journaled on said thrust shaft by said cylindrical part of said receiving collar.

5. A ship drive as defined in claim 4, including an adjusting spring engaging in an axially extending groove in said support collar and arranged on a thread-free section of said cylindrical part of said receiving collar.

6. A ship drive as defined in claim 4, wherein said support collar h as a circumferential region with a cutout extending through a wall of said support collar for actuation of said threaded ring.

7. A ship drive as defined in claim 4, wherein said threaded ring is releasably secured against rotation in both a switched-in and a switched-out setting of said auxiliary thrust bearing.

8. A ship drive as defined in claim 1, wherein said support collar, said receiving collar and said thrust shaft have channels extending through a wall for lubrication of said pressure blocks, said channels being connected together and opening into intermediate spaces occupied by said pressure blocks.

* * * * *